US006475979B2

(12) United States Patent
Barresi et al.

(10) Patent No.: US 6,475,979 B2
(45) Date of Patent: Nov. 5, 2002

(54) REDUCED MALTO-OLIGOSACCHARIDE CLEANSING COMPOSITIONS

(75) Inventors: Frank W. Barresi, Coralville, IA (US); Richard L. Antrim, Solon, IA (US); Susan O. Freers, Muscatine, IA (US)

(73) Assignee: Grain Processing Corporation, Muscatine, IA (US)

( * ) Notice: Subject to any disclaimer, the term of this patent is extended or adjusted under 35 U.S.C. 154(b) by 0 days.

(21) Appl. No.: 09/801,352

(22) Filed: Mar. 7, 2001

(65) Prior Publication Data

US 2002/0072483 A1 Jun. 13, 2002

Related U.S. Application Data

(63) Continuation of application No. PCT/US00/29141, filed on Oct. 20, 2000.

(60) Provisional application No. 60/160,602, filed on Oct. 20, 1999.

(51) Int. Cl.[7] ..... C11D 3/22; C11D 9/00

(52) U.S. Cl. ..... 510/470; 510/130; 510/133; 510/141; 510/143; 510/146; 510/149; 510/151; 510/300; 510/302; 510/374; 510/375; 510/470; 510/473; 510/474; 510/481

(58) Field of Search ..... 510/130, 133, 510/141, 143, 146, 149, 151, 300, 302, 374, 375, 470, 473, 474, 481

(56) References Cited

U.S. PATENT DOCUMENTS

| | | | | |
|---|---|---|---|---|
| 2,280,975 A | | 4/1942 | Power | |
| 3,639,389 A | | 2/1972 | Hull | |
| 3,876,794 A | | 4/1975 | Rennhard | |
| 3,890,300 A | | 6/1975 | Huchette et al. | |
| 3,935,284 A | | 1/1976 | Kruse | |
| 3,963,788 A | | 6/1976 | Kruse et al. | |
| 4,248,895 A | | 2/1981 | Stroz et al. | |
| 4,248,945 A | | 2/1981 | Alvarez et al. | |
| 4,279,931 A | | 7/1981 | Verwaerde et al. | |
| 4,322,569 A | | 3/1982 | Chao et al. | |
| 4,336,152 A | | 6/1982 | Like et al. | 252/106 |
| 4,346,116 A | | 8/1982 | Verwaerde et al. | |
| 4,445,938 A | | 5/1984 | Verwaerde et al. | |
| 4,463,116 A | | 7/1984 | Koyama et al. | |
| 4,675,293 A | | 6/1987 | Gibs | |
| 4,680,180 A | | 7/1987 | Bussiere et al. | |
| 4,717,765 A | | 1/1988 | Hirao et al. | |
| 4,728,510 A | * | 3/1988 | Shibanai et al. | 424/94.5 |

(List continued on next page.)

FOREIGN PATENT DOCUMENTS

| | | | |
|---|---|---|---|
| DE | 197 51 630 A1 | | 5/1999 |
| EP | 0 142 725 A1 | | 8/1987 |
| EP | 0 548 399 A1 | | 6/1993 |
| EP | 0 577 519 B1 | | 1/1994 |
| EP | 0 618 286 | | 10/1994 |
| EP | 0 670 368 A2 | | 9/1995 |
| EP | 0 727 485 A1 | | 8/1996 |
| EP | 0 775 709 A1 | | 5/1997 |
| EP | 0 791 658 A1 | | 8/1997 |
| EP | 0 839 916 A1 | | 5/1998 |
| EP | 0 854 149 A1 | | 7/1998 |
| GB | 526839 | | 9/1940 |
| JP | 4-148661 A | | 5/1992 |
| JP | 05103586 A | | 4/1993 |
| JP | 05294837 A | | 11/1993 |
| JP | 10028531 | | 2/1998 |
| WO | WO 92/14761 A1 | | 9/1992 |
| WO | WO 92/18542 A1 | | 10/1992 |
| WO | WO 95/07303 A1 | | 3/1995 |
| WO | WO 96/11589 A1 | | 4/1996 |
| WO | WO 97/29133 A1 | | 8/1997 |
| WO | WO 97/34861 A1 | | 9/1997 |
| WO | 98/42814 | | 10/1998 |
| WO | 98/42818 | * | 10/1998 |
| WO | 99/11748 | | 3/1999 |
| WO | 99/36442 | * | 7/1999 |
| WO | WO 00/32157 A1 | | 6/2000 |

OTHER PUBLICATIONS

Arts et al., "Hydrogen Peroxide and Oxygen in Catalytic Oxidation of Carbohydrates and Related Compounds," *Synthesis*, 597–613 (Jun. 1997).

Bell et al., "Glass Transition Explanation for the Effect of Polyhydroxy Compounds on Protein Denaturation in Dehydrated Solids," *Journal Of Food Science*, 61 (2), 372–374 (1996).

Bendiak, "Nuclear Magnetic Resonance Spectroscopy of Peracetylated Oligosaccharides having C–labeled carbonyl Groups in lieu of Permethylation Analysis for Establishing Linkage Substitutions of Sugars," *Carbohydrate Research*, 315, 206–221 (1999).

Glattfeld et al, "The Caralytic Dehydrogenation of Sugar Alcohols," *Journals of the American Chemical Society*, 60(9), 2013–2023 (1938).

Heyns et al., "Selektive Katalytische Oxydationen mit Edelmetall–Katalysatoren," *Angewandte Chem.*, 69(13–14), 600–608 (Jul. 15, 1957).

Heyns et al., "Die Darstellung der L–Gulose," *Katalytische Oxydationen*, 91(13), 1720–1724 (1958).

Kearsley et al., "The Production and Properties of Glucose Syrups, III. Sweetness of Flucose Syrups and Related Carbohydrates," *StarchStärke* 32, 244–247 (1980).

(List continued on next page.)

*Primary Examiner*—Charles Boyer
(74) *Attorney, Agent, or Firm*—Leydig, Voit & Mayer LTD

(57) ABSTRACT

Disclosed are cleansing products that include reduced malto-oligosaccharides. In accordance with one embodiment of the invention, a cleansing product includes a surfactant and a reduced malto-oligosaccharide. In accordance with another embodiment, the reduced malto-oligosaccharide is an encapsulant for a product carrier in a powdered laundry-type detergent.

10 Claims, 2 Drawing Sheets

U.S. PATENT DOCUMENTS

| | | | | |
|---|---|---|---|---|
| 4,845,208 | A | | 7/1989 | Fuertes et al. |
| 4,985,553 | A | | 1/1991 | Fuertes et al. |
| 5,034,231 | A | | 7/1991 | Yatka et al. |
| 5,098,893 | A | | 3/1992 | Franks et al. |
| 5,109,128 | A | | 4/1992 | Schumacher et al. |
| 5,290,765 | A | | 3/1994 | Wettlaufer et al. |
| 5,348,737 | A | | 9/1994 | Syed et al. |
| 5,478,593 | A | | 12/1995 | Serpelloni et al. |
| 5,493,014 | A | | 2/1996 | Caboche |
| 5,506,353 | A | | 4/1996 | Subramaniam |
| 5,520,840 | A | | 5/1996 | Massaro et al. ..... 252/174.17 |
| 5,523,108 | A | | 6/1996 | Wansor et al. |
| 5,571,547 | A | | 11/1996 | Serpelloni et al. |
| 5,601,863 | A | | 2/1997 | Borden et al. |
| 5,620,873 | A | | 4/1997 | Ohkuma et al. |
| 5,627,273 | A | | 5/1997 | Thomaides et al. |
| 5,629,042 | A | | 5/1997 | Serpelloni et al. |
| 5,641,477 | A | | 6/1997 | Syed et al. |
| 5,655,552 | A | | 8/1997 | Samain |
| 5,656,584 | A | | 8/1997 | Angell et al. ..... 510/441 |
| 5,690,956 | A | | 11/1997 | Lau |
| 5,720,978 | A | | 2/1998 | Morehouse |
| 5,756,438 | A | | 5/1998 | Rau et al. ..... 510/151 |
| 5,772,013 | A | | 6/1998 | Kunz et al. |
| 5,780,620 | A | | 7/1998 | Mandai et al. |
| 5,795,852 | A | | 8/1998 | He et al. ..... 510/151 |
| 5,853,487 | A | | 12/1998 | Tang et al. |
| 5,866,533 | A | * | 2/1999 | Beck et al. ..... 510/471 |
| 5,900,261 | A | | 5/1999 | Ribadeau-Dumas et al. |
| 5,955,448 | A | | 9/1999 | Colaco et al. |
| 5,965,501 | A | | 10/1999 | Rattinger et al. ..... 510/146 |
| 6,107,348 | A | | 8/2000 | Nakano et al. |

OTHER PUBLICATIONS

Kearsley et al., "Production and Physiochemical Properties of Hydrogenated Glucose syrups," *Die Stärke*, 29(12), 425–429 (1977).

*Handbook of Analytical Derivatization Reactions*, John Wiley & Sons, Inc., New York, New York, 582–584 (1979).

Kusano et al., "Effects of Reduced Malto–Oligosaccharides on the Thermal Stability of Pullulanase form *Bacillus Acidopullulyticus,*" *Carbohydrate Research*, 199(1), 83–89 (1990).

Leroy, "Hydrogenated Starch Hydrolysates," *Health and Sugar Substitutes*, Proc. ERGOB Conference, Geneva, 114–119 (1978).

McNeil, "Elimination of Internal Glycosyl Residues During Chemical Ionization–Mass Spectrometry of Per–O–Alkylated Oligosaccharide–Alditols," *Carbohydrate Research*, 123, 31–40 (1983).

Nakagawa et al. "Construction from a Single Parent of Baker's Yeast Strains with High Freeze Tolerance and Fermentative Activity in Both Lean and Sweet Doughs," Tokyo Research Laboratories, *App. Environ. Microbiol.*, 60(10), 3499–3502 (1994).

O'Brien, "Stability of Trehalose, Sucrose and Glucose to Nonenzymatic Browning in Model Systems," *Journal of Food Science*, 61(4), 679–682 (1996).

Rodriguez de Sotillo et al., "Potato Peel Waste: Stability and Antioxidant Activity of a Freeze–Dried Extract," *Journal of Food Science*, 59(5), 1031–1033 (1994).

Röper, "Selective Oxidation of D–Glucose: Chiral Intermediates for Industrial Utilization," Carbohydrates as Organic Raw Materials, 268–288 (1991).

Rossi et al., "Stabilization of the Restriction Enzyme EcoRI Dried with Trehalose and Other Selected Glass–Forming Solutes," *Biotechnol. Prog.*, 13(5), 609–616 (1997).

Schebor et al., "Glassy State and Thermal Inactivation of Invertase and Lactase in Dried Amorphous Matrices," *Biotechnology Process*, 13(6), 857–863 (Abstract) (1997).

Bender, "Studies of the Inhibition by Malto–Oligosaccharides of the Cyclization Reaction Catalyzed by the Cyclodextrin Glycosyltransferase from Klebsiella Pneumoniae M 5 al with Glycogen," *Carbohydr. Res.*, 135(2), 291–302 (Abstract) (1985).

* cited by examiner

REDUCED MALTO-OLIGOSACCHARIDE CLEANSING COMPOSITIONS

TECHNICAL FIELD OF THE INVENTION

The present invention relates to cleansing compositions.

BACKGROUND OF THE INVENTION

It is known in the art that soluble starches, maltodextrins, and other carbohydrates can be used in the production of cleansing bars as structurants, fillers and thickening agents (see U.S. Pat. Nos. 5,965,501; 5,756,438, 5,795,852, and 5,520,840). Carbohydrates are particularly useful when the cleansing bar includes a synthetic cleansing agent. Such cleansing agents often are more effective at dissolving dirt and oils than natural soap, but may be deemed too harsh on the skin or otherwise undesirable for use as a cleansing bar without the incorporation of a filler into the bar.

The use of carbohydrates such as starches and maltodextrins in laundry detergent also is known in the art (see U.S. Pat. No. 5,656,584). However, processing conditions for the production of cleansing compositions may expose the carbohydrate components to alkaline, thermal, and/or high shear conditions that may cause the carbohydrate to degrade. The degradation of the carbohydrate can manifest itself in yellowing of the cleansing composition, or in an overall loss of performance of the cleansing composition. There is thus a need in the art for a carbohydrate material that can withstand the processing conditions used in the preparation of such cleansing compositions. There is also a need in the art for a cleansing composition that is resistant to yellowing and loss of performance due to degradation of the carbohydrate.

THE INVENTION

The present invention is based on the surprising discovery that a reduced malto-oligosaccharide may be used in connection with a cleansing composition to provide a cleansing composition that includes superior colorfastness, thickening ability, mildness, textural feel, and structural integrity, as well as increased billet density and enhanced shelf life stability. The invention thus provides a cleansing composition that includes a cleansing agent and a structurant, filler, or thickener, the structurant, filler, or thickener comprising a reduced malto-oligosaccharide. Other components, such as modifiers, binders, water, fragrances, and other ingredients further may be included. In one embodiment of the invention, the cleansing composition takes the form of a bar soap. In another embodiment, the cleansing composition takes the form of a powdered laundry-type detergent. In this embodiment, the reduced malto-oligosaccharide preferably constitutes an encapsulating material for a carrier material, such as a perfume-containing material. In another embodiment, the cleansing composition takes the form of a liquid laundry detergent. The liquid laundry detergent includes a reduced malto-oligosaccharide as a thickener or structurant (for instance, as a carrier for enzymes in the laundry detergent or as an encapsulant for other materials).

DESCRIPTION OF THE PREFERRED EMBODIMENTS

Figure 1:
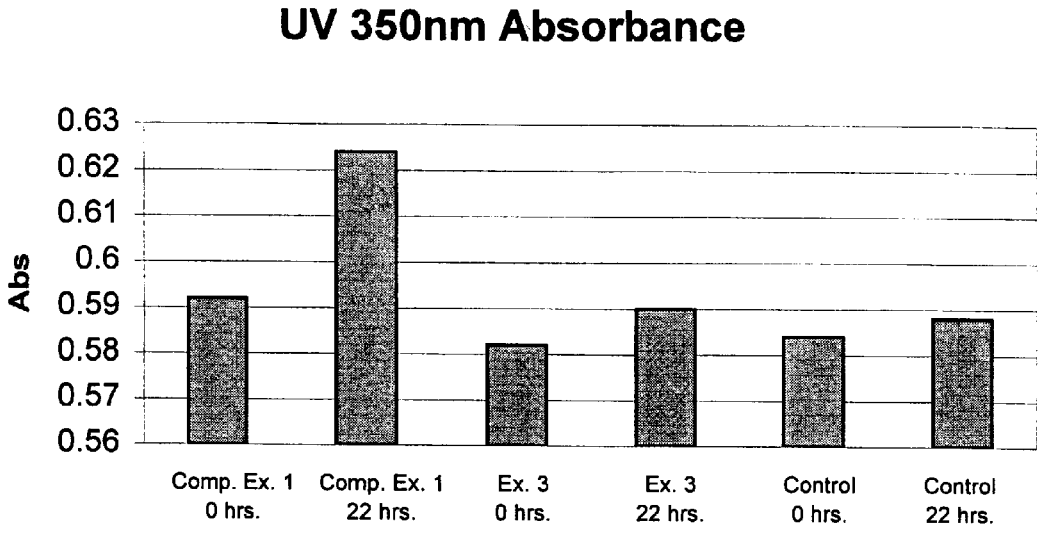
FIGS. 1–4 graphically illustrate UV absorbance data presented in Example 3 and Comparative Example 1.

The invention incorporates reduced malto-oligosaccharides species. While the reduced malto-oligosaccharide species can be obtained by any suitable method, they are preferably prepared via reduction of readily available malto-oligosaccharide mixtures, e.g., as described in U.S. patent application Ser. No. 09/366,065 (corresponding to PCT/US99/01098). Malto-oligosaccharide mixtures suitable for reduction to form reduced malto-oligosaccharides are sold by Grain Processing Corporation of Muscatine, Iowa under the MALTRIN® product designation, these including, for example, MALTRIN® M040, MALTRIN® M050, MALTRIN® M100, MALTRIN® M150, and MALTRIN® M180. It will be appreciated that naturally occurring malto-oligosaccharides typically contain a mixture of a plurality of malto-oligosaccharide species. As such, the reduced malto-oligosaccharide species obtained by reduction of such naturally occurring precursors likewise will contain a plurality of reduced malto-oligosaccharide species.

Oligosaccharides can be prepared by the controlled hydrolytic cleavage of starches. In the production of such oligosaccharides, the glycoside linkages of the starch molecules are partially hydrolyzed to yield at least one oligosaccharide species, and more typically, a mixture of oligosaccharide species. Each oligosaccharide species in the mixture may be characterized by its degree of polymerization (DP), which refers to the number of saccharide units in the molecule. Each oligosaccharide species also may be characterized by its dextrose equivalent (DE), which generally indicates the proportion of aldehyde, hemiacetal or ketone terminal groups in the molecule, and which is a measure of the reducing sugar content of the oligosaccharide, expressed as a percentage of the total dry substance. The DE value and DP profile for a given oligosaccharide mixture can vary substantially, depending, for example, upon the type of starch precursor used to obtain the mixture and the conditions employed for hydrolysis of the base starch.

When a reduced malto-oligosaccharide species is obtained by reduction of a malto-oligosaccharide precursor, it will be appreciated that the DP value of the reduced product may be different from the DP value of the precursor. The malto-oligosaccharide preferably is reduced under conditions such that when a single reduced malto-oligosaccharide species is obtained by reduction of a malto-oligosaccharide precursor, the DP value of the reduced malto-oligosaccharide species preferably is substantially preserved. Similarly, when a mixture of a plurality of reduced malto-oligosaccharide species is obtained by reduction of a mixture of a plurality of malto-oligosaccharide species, the DP profile for the product preferably is substantially retained, e.g., as described in U.S. patent application Ser. No. 09/366,065 (corresponding to PCT/US99/01098). Preferably, the reduced malto-oligosaccharide species used in accordance with the present invention has a DE of less than about 1.

The reduced malto-oligosaccharide species used in conjunction with the invention can have any suitable DP value, preferably 2 or greater and typically greater than 2 (e.g., DP of 5 or greater). In a preferred embodiment, the preserving agent includes a mixture of a plurality of reduced malto-oligosaccharide species differing at least in DP value thus defining a DP profile for the mixture. When a mixture of a plurality of reduced malto-oligosaccharide species is utilized, it is preferred that at least one of the reduced malto-oligosaccharide species has a DP greater than 5, more preferably greater than about DP 8, and most preferably greater than about DP 10.

In a preferred embodiment, at least about 80% of the reduced malto-oligosaccharide species have a DP greater than 5. More preferably at least about 60% of the reduced malto-oligosaccharide species have a DP greater than 8. Still more preferably, at least about 60% of the reduced malto-oligosaccharide species have a DP greater than 10. Most preferably, at -least about 80% of the reduced malto-oligosaccharide species have a DP greater than 10. In a particularly pre erred embodiment, at least about 75% of the reduced malto-oligosaccharide species in the mixture have a DP greater than 5 and at least about 40% of the reduced malto-oligosaccharide species in the mixture have a DP greater than 10.

While the reduced malto-oligasaccharide species of the preserving agent of the present invention are comprised of sugar units having different glucose linkages (typically 1,4- and 1,6-linkages) it is preferred that the majority of glucose units in the reduced malto-oligosaccharide species are 1,4-linked. When a mixture of a plurality of reduced malto-oligosaccharide species is used in the preserving agent of the present invention, it is highly preferred that and at least about 80% of the species in the mixture have a DP greater than 5. The structurant may include other starches, maltodextrins, dextrins, or sugars such as dextrose or sorbitol.

The reduced malto-oligosaccharides used in accordance with the present invention include modified reduced malto-oligosaccharides. Examples of modified reduced malto-oligosaccharides can be found, for example, in PCT/US00/40687, describing derivatized reduced malto-oligosaccharides. Derivatized reduced malto-oligosaccharides can include, for example, reduced malto-oligosaccharides that incorporate one or more substituents or chemical modifications in one or more positions on one or more saccharide units. Such substituents can be introduced, for example, by hydroxyalkylation, oxidation, etherification, and esterification reactions. By way of example, one or more primary alcohol positions in one or more saccharide units can be oxidized to form one or more carboxylic acids. Etherification reactions can include, for example, ethoxylations, propoxylations and other alkylations, as well as reactions that can introduce a cationic charge by using reagents such as, for example, 3-chloro-2-hydryoxypropyl-trimethylammonium chloride, or the like. Esterification reactions can include, for example, acylation reactions in which an acyl group (e.g., having from about 2 to 20 carbon atoms) is introduced to one or more saccharide units. It is contemplated that enzymatically modified reduced malto-oligosaccharides may be used in conjunction with the invention, as well as reduced malto-oligosaccharides that have been otherwise modified.

The cleansing composition of the invention further includes a cleansing agent. When the cleansing composition of the invention takes the form of a soap bar, the cleansing composition preferably includes a natural soap, i.e., the saponification product resulting from alkaline treatment of triglycerides. The cleansing agent preferably further includes a synthetic surfactant, such as an anionic, nonionic, or amphoteric surfactant. Any suitable surfactant known in the art or otherwise found to be suitable may be used in conjunction with the invention, and thus the cleansing agent may include products such as sodium lauryl sulfate, stearic acid, sodium stearate, sodium methylcocoyltaurate, benzene sulfonate, sorbitan laurate, cocamidopropylbetaine, acylisethionate, and alkyl polyglucosides, and, in general, any surfactant or cleansing agent useful in connection with the preparation of a soap bar or a "non-soap" type bar. Other synthetic surfactants include sodium alkylsulfate and homologous ethoxylated versions and sulfonates, such as sodium cocoylisethionate. Nonionic surfactants include ethoxylated fatty materials. Amphoteric surfactants include cocoamidopropyl betaine and cocoamphoacetate. Further details concerning the cleansing agent may be found in "Soap," in *Kirk-Othmer Encyclopedia of Chemical Technology,* 4th ed., vol. 22 (1997). It is contemplated that the reduced malto-oligosaccharides are useful in conjunction with soaps in which the cleansing agent consists exclusively of natural soap, but the invention is contemplated to find greatest applicability in the case of cleansing bars in which some or all of the cleansing agent includes a synthetic surfactant.

The soap bar may include other soap additives as may be known in the art or otherwise found to be suitable in conjunction with the invention. For instance, the soap may include a free fatty acid, such as coconut or palm kernel, for association with the cleansing agent to form soap crystals. The soap may include a colorant, such as titanium dioxide, and/or a fragrance to improve the aesthetic properties of the soap bar. An antioxidant, such as EDTA (ethylene diamine tetraacetic acid), EHDP (sodium etidronate), or citric acid may be employed. A chelant, such as magnesium silicate, may be included. The soap bar may include a humectant, such as glycerol, and may include a mildness additive, such as lanolin, vitamin E, aloe vera gel, mineral oil, or baking soda. If desired, an antimicrobial agent, such as TCC (trichlorocarbanalide) (or TCS (trichlorohydroxydiphenyl ether) which have activity against a wide range of micro-organisms may be used. Other ingredients, such as abrasive agents (including such materials as pumice) and solvents (including glycerol), triethanolamine, ethyl alcohol, and sugars also may be incorporated. Other suitable ingredients include waxes, glycerol stearate, and polyethyeneglycols, such as PEG 150, as well as emollients and other ingredients useful in connection with the preparation of a bar soap. The foregoing optional ingredients may be incorporated in any amounts suitable to achieve their intended affect in the soap bar.

In one embodiment of the invention, the reduced malto-oligosaccharide is used in conjunction with the production of a bar soap. The bar soap has the following typical composition:

| | |
|---|---|
| SURFACTANT SYSTEM | 5–90% |
| STRUCTURANT | 10–85% |
| MODIFIERS/BINDERS | 0–25% |
| WATER | 0–15% |
| MISCELLANEOUS | 0–70% |
| TOTAL | 100% |

In another embodiment, the reduced malto-oligosaccharide may be used in connection with the preparation of a laundry detergent. U.S. Pat. No. 5,656,584 purports to disclose a process for producing a particulate laundry additive composition, the process including mixing a porous carrier material, typically containing perfume, and an encapsulating material, typically a carbohydrate material, and then compacting the mixture to form agglomerates. In accordance with an embodiment of the present invention, the process for producing a particulate laundry additive preferably includes encapsulating a carrier material with a reduced malto-oligosaccharide encapsulating material, and then compacting the material to form agglomerates.

More generally, the reduced malto-oligosaccharide may be used in other respects in connection with the preparation of laundry detergents, for instance, as a structurant. The laundry detergent may be in the form of a liquid laundry detergent or a solid laundry detergent, such as a powdered detergent. In accordance with the invention, the detergent comprises a cleansing agent, preferably a synthetic surfactant as discussed hereinabove, and a reduced malto-oligosaccharide. The laundry detergent may, of course, contain other additives as are known in the art or are otherwise may be found suitable in connection with the preparation of a laundry detergent. Typical laundry detergents include builders, which are substances that augment the detersive effects of surfactants. Typically, such builders are added to remove hard water ions from the wash water, i.e., to soften the water. Known builders include such ingredients as pentisodium triphosphate, tetrisodium pyrophosphate, trisodium phosphate, and glassy phosphates such as sodium polyinetaphosphate, sodium hexametaphosphate, and potassium phosphates. Other builders include materials such as carbonates, silicates, zeolites, clays, NTA (nitrilotriacetic acid, trisodium salt), and neutral soluble salts. Further details concerning suitable builders may be found in "Detergency," in *Kirk-Othmer Encyclopedia of Chemical Technology* vol. 7 (1997)

The detergent may include other additives, such as antiredeposition agents, including sodium carboxymethycellulose and other cellulose derivatives, fluorescent whitening agents or blueing agents, or bleaching agents, such as sodium perborate trihydrate. Other ingredients useful in connection with detergents include foam regulators and organic sequestering agents. Such optional ingredients may be present in any amount suitable for their intended purpose.

Many laundry detergents include enzymes, such as proteolytic enzymes and cellulase enzymes. In accordance with the invention, the reduced malto-oligosaccharide may be present in the detergent composition as a carrier for the enzymes. The carrier may be prepared by introducing the enzyme onto a substrate, the substrate comprising the reduced malto-oligosaccharide. When used in this regard, the enzyme may be present in a ratio with respect to the reduced malto-oligosaccharide of about 1:1 to about 1:1000.

The cleansing composition may take any other suitable form, such as a liquid soap, a shampoo, a bath gel, a hand or automatic dishwashing detergent, a personal care product used for cleansing, or any other suitable form.

The following examples further illustrate the present invention but, of course, should not be construed as in any way limiting its scope.

EXAMPLE 1

Preparation of a Cleansing Bar

Polyethylene glycol 6000, 50 g; glycerol stearate, 25 g; stearic acid, 10 g; titanium dioxide, 0.1 g; and paraffin wax 2.5 g; are blended together to form a melt-like composition. A reduced malto-oligosaccharide, 200 g; sodium lauryl sulfate, 20 g; and sodium cocoyl isethionate, 80 g; are then added and the moisture level is adjusted to 5 wt. %. The temperature is brought to 100° C., and the mixture blended for 30 minutes. The composition is then cooled on a chill roll and chipped. The resultant chips are then plodded until a desired density is achieved, and the resulting extrudate is cut into billets. The resulting billets are then compacted into bars.

EXAMPLE 2

This Example illustrates the preparation of a powdered soap.

Stearic acid, 50 g and canola oil, 5 g, were dry blended together and heated to 75° C. 50% Sodium Hydroxide, 15.0 g, was added drop-wise during the heating process. Once the blend was a. 75° C., reduced malto-oligosaccharide, 20 g, was added to the blend. The reduced malto-oligosaccharide had the same DP profile as MALTRIN M100. Stirring continued for another 10 minutes and then the powder was removed from the heat and stirred manually for another 10 minutes. The resulting powder did not develop any color. The powder was sifted through a 20 mesh screen.

Comparative Example 1

As a comparison with the soap of Example 2, stearic acid, 50 g and canola oil, 5 g, were dry blended together and heated to 75° C. 50% Sodium Hydroxide, 15.5 g, was added drop-wise during the heating process. Once the blend was at 75° C., MALTRIN M100, 20 g, was added to the blend. Stirring continued for another 10 minutes and then the powder was removed from the heat and stirred manually for another 10 minutes. The resulting powder became yellow. The powder was sifted through a 20 mesh screen. This soap was less homogeneous than the soap of Example 2.

Minolta color values were obtained using a Minoltachroma meter CR-300 from Minolta Corp. Ramsey, N.J. from the soap compositions of Example 2 and Comparative Example 1. The following results were determined.

| | | Minolta Color* | | |
|---|---|---|---|---|
| Sample | % Moisture | L | A | B |
| Comparative Example 1 | 92.2 | 91.90 | −4.92 | 12.24 |
| Example 2 | 91.4 | 95.24 | −5.55 | 9.20 |

L values: L = 100 = white, L = O = black
A = 100 = red, A = −80 = green
B = 70 = yellow. B = −70 = blue
*From reference manual for Minoltachroma Meter CR-300, CR 310, and CR-331 (1991)

As demonstrated by these results, the soap of Example 2 had significantly greater white color and significantly less yellow color than the soap of Comparative Example 1

EXAMPLE 3

This Example illustrates the advantages of using reduced malto-oligosaccharides in a liquid laundry detergent.

Figure 2:
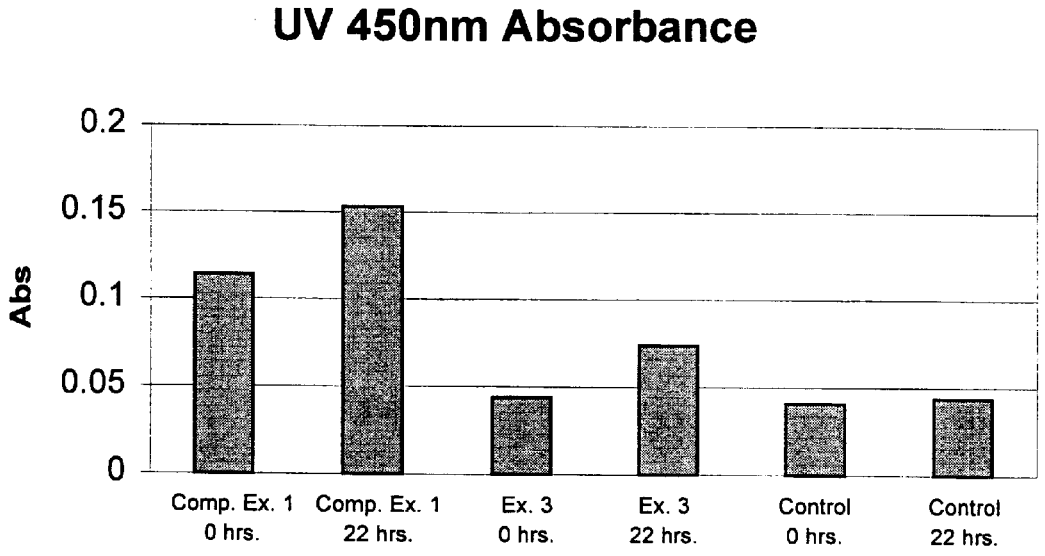
Figure 3:
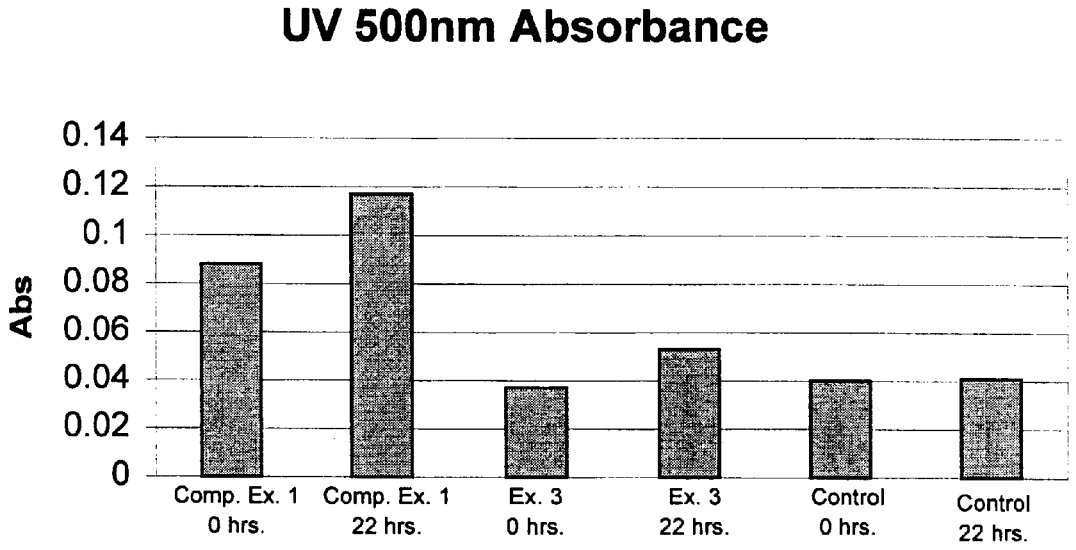
Figure 4:
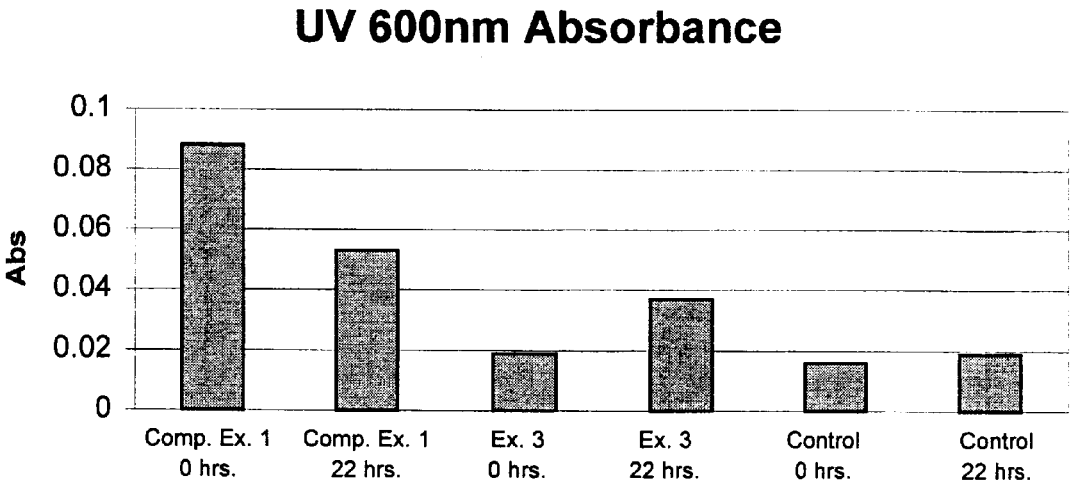

Reduced malto-oligosaccharide 10.4 g (4.1 moisture) with a carbohydrate profile that matches MALTRIN® M180 was added to a commercially available household liquid laundry detergent, 89.3 g. The mixture was stirred for approximately 30 minutes to allow the reduced malto-oligosaccharide to completely dissolve in the liquid detergent. Once completely dissolved, the pH of the solution was measured, and a 1.0 ml aliquot was removed for UV analysis. The mixture was then incubated in a 60° C. water bath for 22 hours. The sample was again pH and UV analyzed. UV analysis was accomplished by diluting the 1.0 ml samples with 5 ml of water in a test tube and stirring the sample in a vortex mixer. The UV absorbance of the sample was then measured at several wavelengths. The data is shown in Table 1 and FIGS. 1–4.

As a control, MALTRIN M180, 10.7 g (6.4% moisture) was added to a commercially available household liquid laundry detergent, 89.3 g. The mixture was stirred for approximately 30 minutes to allow the malto-oligosaccharide to completely dissolve in the liquid detergent. Once completely dissolved, the pH of the solution was measured, and a 1.0 ml aliquot was removed for UV analysis. The mixture was then incubated in a 60° C. water bath for 22 hours. The sample was again pH and UV analyzed. UV analysis was accomplished by diluting the 1.0 ml samples with 5 ml of water in a test tube and stirring the sample in a vortex mixer. The UV absorbance of the sample was then measured at several wavelengths. The data is shown in Table 1 and FIGS. 1–4.

Comparative Example 1

A commercially available household liquid laundry detergent, 100 g, was stirred in an Erlenmeyer flask for approximately 30 minutes. The pH of the solution was measured, and a 1.0 ml aliquot was removed for UV analysis. The liquid was then incubated in a 60° C. water bath for 22 hours. The sample was again pH and UV analyzed. UV analysis was accomplished by diluting the 1.0 ml samples with 5 ml of water in a test tube and stirring the sample in a vortex mixer. The UV absorbance of the sample was then measured at several wavelengths. The data is shown in Table 1 and FIGS. 1–4.

| | | | | UV absorbance (nm) | | | |
|---|---|---|---|---|---|---|---|
| Sample | Time | Temp | pH | 350 | 450 | 500 | 600 |
| Comparative Example 1 | 0 | 25 | 7.5 | 0.592 | 0.114 | 0.088 | 0.088 |
| | 22 | 60 | 7.2 | 0.624 | 0.153 | 0.117 | 0.053 |
| Example 3 | 0 | 25 | 7.3 | 0.582 | 0.044 | 0.037 | 0.019 |
| | 22 | 60 | 7.3 | 0.59 | 0.074 | 0.053 | 0.037 |
| Control | 0 | 25 | 8 | 0.584 | 0.041 | 0.04 | 0.016 |
| | 22 | 60 | 7.9 | 0.588 | 0.044 | 0.041 | 0.019 |

As is demonstrated by the foregoing data, the reduced malto-oligosaccharide product did not significantly increase the UV absorbance over time of the laundry detergent. The reduced malto-oligosaccharide thus is particularly suitable for use as a filler or enzymatic carrier in connection with such laundry detergent. On the other hand, the UV absorbance increased dramatically when unreduced MALTRIN@ M180 was incorporated, thus indicating that color change and possibly cross-reactivity are more likely.

It is thus seen that the reduced malto-oligosaccharides are more inert than are regular malto-oligosaccharides as indicated by less color formation and better pH stability. Reduced malto-oligosaccharides thus may be used as an additive in laundry detergent formulation with less potential for cross-reactivity than regular malto-oligosaccharides. Reduced malto-oligosaccharides also are more heat-stable than their unreduced counterparts, which may provide additional advantages in some cleansing applications.

All of the references cited herein, including patents, patent applications, and publications, are hereby incorporated in their entireties by reference.

While this invention has been described with an emphasis upon preferred embodiments, it will be apparent to those of ordinary skill in the art that variations of the preferred embodiments may be used and that it is intended that the invention may be practiced otherwise than as specifically described herein. Accordingly, this invention includes all modifications and equivalents encompassed within the spirit and scope of the invention as defined by the following claims.

What is claimed is:

1. A cleansing composition comprising:

a cleansing agent; and a mixture of a plurality of reduced malto-oligosaccharide species, said mixture having a dextrose equivalent (DE) of essentially zero, said plurality of malto-oligosaccharide species differing at least in degree of polymerization (DP) value thus defining a DP profile for said mixture, at least about 40% of said malto-oligosaccharides in said mixture having a DP value greater than 10, said plurality of malto-oligosaccharides comprising a maltodextrin.

2. A cleansing composition according to claim 1, said cleansing composition taking the form of a bar soap.

3. A cleansing composition according to claim 2, said cleansing agent consisting essentially of natural soap.

4. A cleansing composition according to claim 1, said cleansing composition taking the form of a powdered detergent.

5. A cleansing composition according to claim 4, said powdered detergent including an enzyme, said enzyme being carried on a carrier which comprises a reduced malto-oligosaccharide.

6. A cleansing composition according to claim 4, said powdered detergent comprising a plurality of spray dried particles.

7. A cleansing composition according to claim 1, said cleansing composition taking the form of a liquid soap.

8. A cleansing composition according to claim 7, said cleansing agent including a synthetic surfacant.

9. A cleansing agent according to claim 8, further including a detergent builder.

10. A cleansing agent according to claim 6, further including a bleaching agent.

* * * * *

UNITED STATES PATENT AND TRADEMARK OFFICE

CERTIFICATE OF CORRECTION

PATENT NO. : 6,475,979 B2
DATED : November 5, 2002
INVENTOR(S) : Barresi et al.

It is certified that error appears in the above-identified patent and that said Letters Patent is hereby corrected as shown below:

Title page,
Item [75], Inventors, "Susan O. Freers" should not be listed as an inventor.

Column 3,
Line 5, "-least" should read -- least --.
Line 7, "pre erred" should read -- preferred --.

Column 5,
Line 22, "(1977)" should read -- (1977). --.

Column 6,
Line 67, "the malto-" should read -- the reduced malto --.

Column 7,
Line 11, add paragraph.
-- As a control, MALTRIN M180, 10.7 g (6.4% moisture) was added to a commercially available household liquid laundry detergent, 89.3 g. The mixture was stirred for approximately 30 minutes to allow the malto-oligosaccharide to completely dissolve in the liquid detergent. Once completely dissolved, the pH of the solution was measured, and a 1.0 ml aliquot was removed for UV analysis. The mixture was then incubated in a 60º C water bath for 22 hours. The sample was again pH and UV analyzed. UV analysis was accomplished by diluting the 1.0 ml samples with 5 ml of water in a test tube and stirring the sample in a vortex mixer. The UV absorbance of the sample was then measured at several wavelengths. The data is shown in Table 1 and FIGS. 1-4. --
Line 43, "MALTRIN@" should read -- MALTRIN® --.

Signed and Sealed this

Eighteenth Day of March, 2003

JAMES E. ROGAN
*Director of the United States Patent and Trademark Office*